US007167571B2

(12) United States Patent
Bantz et al.

(10) Patent No.: US 7,167,571 B2
(45) Date of Patent: Jan. 23, 2007

(54) AUTOMATIC AUDIO ADJUSTMENT SYSTEM BASED UPON A USER'S AUDITORY PROFILE

(75) Inventors: David F. Bantz, Chappaqua, NY (US); Thomas E. Chefalas, Somers, NY (US); Alexei A. Karve, Mohegan Lake, NY (US); Steven J. Mastrianni, Unionville, CT (US); Ajay Mohindra, Yorktown Heights, NY (US)

(73) Assignee: Lenovo Singapore Pte. Ltd, Singapore (SG)

( * ) Notice: Subject to any disclaimer, the term of this patent is extended or adjusted under 35 U.S.C. 154(b) by 690 days.

(21) Appl. No.: 10/090,888

(22) Filed: Mar. 4, 2002

(65) Prior Publication Data

US 2003/0165247 A1 Sep. 4, 2003

(51) Int. Cl.
*H04R 25/00* (2006.01)

(52) U.S. Cl. ..... 381/312; 381/60

(58) Field of Classification Search ..... 381/60, 381/312–313, 314–318, 58, 77, 79, 97–98; 455/569.1, 415, 412; 379/430–431
See application file for complete search history.

(56) References Cited

U.S. PATENT DOCUMENTS

| | | | | |
|---|---|---|---|---|
| 5,012,520 | A * | 4/1991 | Steeger | 381/315 |
| 5,202,927 | A | 4/1993 | Topholm | 381/68 |
| 5,610,988 | A * | 3/1997 | Miyahara | 381/312 |
| 6,229,900 | B1 * | 5/2001 | Leenen | 381/314 |
| 6,549,633 | B1 * | 4/2003 | Westermann | 381/312 |
| 6,694,034 | B1 * | 2/2004 | Julstrom et al. | 381/315 |
| 6,832,039 | B1 * | 12/2004 | Nami | 386/69 |
| 2003/0086583 | A1 * | 5/2003 | Maltan et al. | 381/315 |
| 2004/0013280 | A1 * | 1/2004 | Niederdrank | 381/315 |

* cited by examiner

*Primary Examiner*—Suhan Ni
(74) *Attorney, Agent, or Firm*—Harrington & Smith, LLP; Carlos Munoz-Bustamante

(57) ABSTRACT

A system for adjusting audio output including a transmitter unit adapted to be carried by a user and a sound generating system. The transmitter unit includes a memory and a signal transmitter. The sound generating system includes a sound generator, a signal receiver, means for altering a sound signal from the signal generator based upon a signal transmitted by the transmitter to the receiver, and speakers connected to the altering means.

32 Claims, 4 Drawing Sheets

AUTOMATIC AUDIO ADJUSTMENT SYSTEM BASED UPON A USER'S AUDITORY PROFILE

BACKGROUND OF THE INVENTION

1. Field of the Invention

The present invention relates to methods and apparatus to provide for the automatic adjustment of computer-generated audio based on an audio profile of a user.

2. Description of the Related Art

A large percentage of the population suffers from some type of hearing disorder or hearing loss. As a greater number of people live longer due to advances in health care, many of these people suffer degenerative effects of aging on the hearing process, such as the inability to filter out background noise, the inability to distinguish speech, tinnitus, and the general fall off of frequency response starting at 4 Hz. Many types of hearing aids have been developed to combat these situations. A device called the Radiant Beam Array is worn around the neck as a necklace and includes an array of six microprocessors and a digital signal processor (DSP). The Starkey Cetera and Phonak Claro use a DSP to provide for altering voice over noise, similar to the way the Dolby noise reduction system works in audio. The Widex Senso-Plus uses a DSP to provide time domain processing to separate speech from background noise. All of these systems need to be configured or programmed before use, then the device is inserted in the ear.

These systems are reactive. They attempt to filter the ambient audio information to eliminate noise and provide better separation between the desired audio information and the background noise. In some cases, these devices are preprogrammed for a particular type of environment or user, and others claim to react in real time. None of these devices are proactive. Each device must be programmed specifically for the individual. If the user loses the device, he must obtain a replacement with the same characteristics. These devices also don't work well with computer systems which emit audio suitable for mass consumption in standard frequencies, sampling rates, and nominal amplitudes.

SUMMARY OF THE INVENTION

In accordance with one aspect of the present invention, a system for adjusting audio output is provided including a transmitter unit adapted to be carried by a user and a sound generating system. The transmitter unit includes a memory and a signal transmitter. The sound generating system includes a sound generator, a signal receiver, means for altering a sound signal from the signal generator based upon a signal transmitted by the transmitter to the receiver, and at least one acoustic transducer connected to the altering means.

In accordance with another aspect of the present invention, a portable signal transmitter unit is provided comprising a battery; a signal transmitter connected to the battery for transmitting a wireless signal; and a memory connected to the signal transmitter. The memory comprises hearing information regarding a user's auditory characteristics. The signal transmitter is adapted to transmit at least a portion of the hearing information stored in the memory.

In accordance with another aspect of the present invention, a sound generating system is provided comprising a processor; a first sound generator connected to the processor; a second sound generator connected to the first sound generator by a programmable sound signal modifier; a combiner for combining an output from the second sound generator with a portion of an output from the signal modifier; and a wireless signal receiver connected to the processor. The receiver is adapted to receive a hearing information signal containing a user's auditory characteristics. The processor is adapted to configure the modifier based upon the hearing information signal received by the receiver.

In accordance with one method of the present invention, a method of altering an electrical sound signal is provided comprising steps of receiving a hearing adjustment signal from a portable transmitter, the hearing adjustment signal comprising information regarding a user's auditory characteristics; configuring a variable signal modifier based upon the received hearing adjustment signal; and transmitting the electrical sound signal through the variable signal modifier and outputting at least one altered electrical sound signal which has been altered based upon the user's auditory characteristics contained in the hearing adjustment signal.

BRIEF DESCRIPTION OF THE DRAWINGS

The foregoing aspects and other features of the present invention are explained in the following description, taken in connection with the accompanying drawings, wherein:

FIG. 6 is a flow chart of one method of the present invention; and.

DETAILED DESCRIPTION OF THE PREFERRED EMBODIMENT

Figure 1:
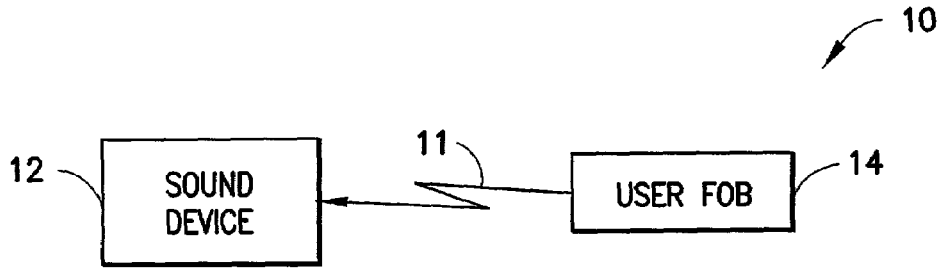
FIG. 1 is a block diagram of a system incorporating features of the present invention.

The present invention relates to methods and apparatus to provide for the automatic adjustment of computer generated audio based on the auditory profile of a user. Referring to FIG. 1, there is shown block diagram of a system 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The system 10 generally comprises a sound device 12 and a user FOB 14. In an alternate embodiment, the system 10 could comprise additional components. The sound device 12 preferably comprises a computer, such as a desktop computer, a laptop computer, or a client computer connected to a network. However, features of the present invention could be used with any suitable type of sound device including, for example, an audio stereo system or an audio mixing system.

Figure 2:
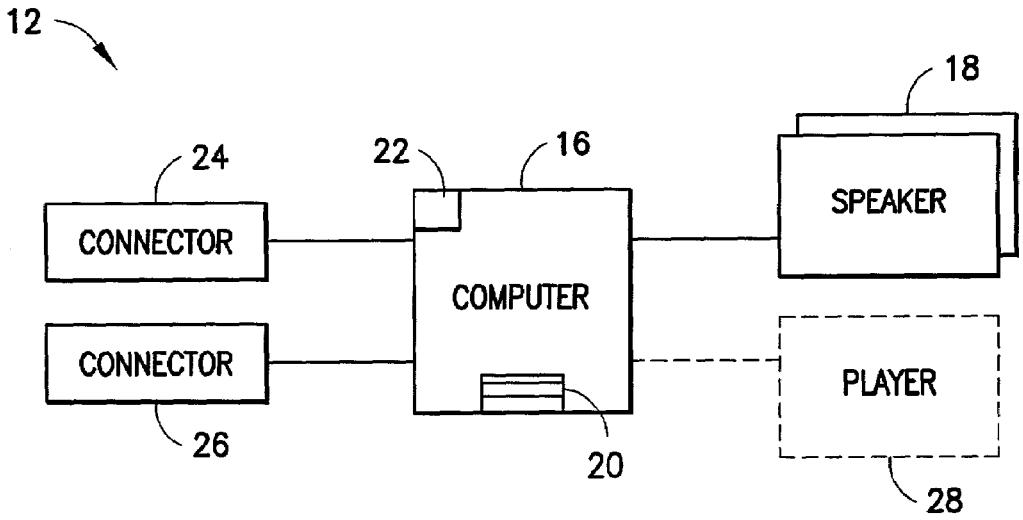
FIG. 2 is a block diagram of the a sound device shown in FIG. 1.

Referring also to FIG. 2, the sound device 12 generally comprises a computer 16, speakers 18, a CD-ROM or DVD player 20, a receiver 22, a first connector 24 and a second connector 26. The computer 16 generally comprises a controller, a memory and a display. The computer could also be connected to another audio player 28, such as a keyboard or MP3 player. The first connector 24 is adapted for connecting the computer 16 to the Internet, such as a modem. The second connector 26 is adapted to connect auxiliary components to the computer 16, such as a stereo headphone set or at least one acoustic transducer. The computer, speakers, connectors and player shown in FIG. 2 are substantially conventional components with the exception of the receiver 22, certain components as shown in FIG. 3, and certain programming in the computer 16.

The computer 16 is adapted to broadcast sound from the speakers 18, or transmit sound signals to the connector 26, based upon sound signals received or read by the player 20, or connector 24, or player 28. The receiver 22 is connected to the controller or central processing unit of the computer 16. In the embodiment shown, the receiver 22 is a wireless receiver, such as a radio frequency receiver. However, in alternate embodiments, any suitable type of receiver could be used, such as an optical receiver or an induction receiver. The receiver 22 could alternatively comprise an electrical connector, such as when the user FOB 14 comprises a mating electrical connector.

Figure 3:
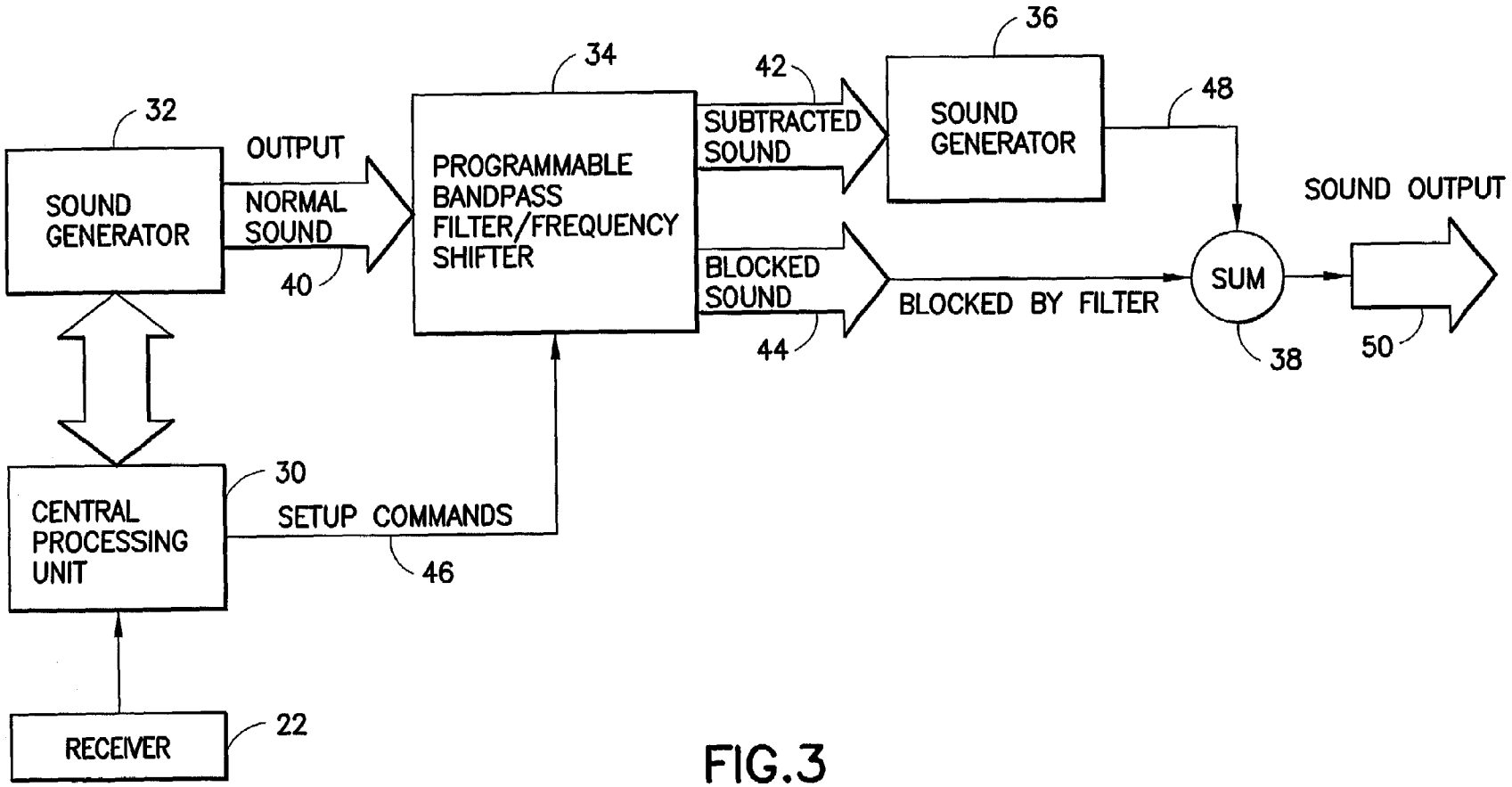
FIG. 3 is a block diagram of components of the computer shown in FIG. 3.

Referring also to FIG. 3, the computer 12 generally comprises the receiver 22, a central processing unit (CPU) 30, a first sound generator 32, an electrical sound signal modifier 34, a second sound generator 36 and a summation engine 38. The CPU 30 is adapted to control the sound generator 32 to output an ordinary electrical sound signal 40. The sound generator 32 preferably comprises the player 20 and connections to the player 28 and connector 24. The sound signal 40 is preferably not amplified yet.

The output from the first sound generator 32 is connected to the modifier 34. In a preferred embodiment, the modifier 34 comprises a programmable bandpass filter and a programmable frequency shifter. However, in an alternate embodiment, the modifier might not comprise a frequency shifter. The modifier 34 comprises two outputs 42, 44. The bandpass filter portion of the modifier 34 is adapted to separate portions of the input sound signal 40 corresponding to predetermined frequencies ("subtracted sound") from portions of the signal 40 which do not correspond to the predetermined frequencies ("blocked sound"). In a preferred embodiment, the bandpass filter portion comprises an array of individually programmable bandpass filters. The subtracted sound is output from the first output 42. The blocked sound is output at the second output 44. Before the separated portions of the sound signal are output at the outputs 42, 44, portions can be shifted in frequency by the frequency shifter portion of the modifier 34 if desired.

The modifier 34 is operably controlled by the CPU 30. More specifically, the CPU 30 is adapted to send setup commands 46 to the modifier 34. In an alternate embodiment, the commands 46 could be dynamic and continuing and, not merely static initial setup commands. The set up commands 46 are used by the modifier 34 to configure it's bandpass filter portion and its frequency shifter portion as further understood from the description below.

The first output 42 is connected to the second sound generator 36. In a preferred embodiment, the second sound generator 36 comprises an amplifier. Output 48 from the second sound generator 36 and the second output 44 are fed as input to the summation engine 38. The summation engine 38 is adapted to add or concatenate the two signals. The resulting signal 50 is then preferably output from the summation engine 38 to drive the sound output generator portion of the computer system's sound card or similar sound output generator.

Figure 4:
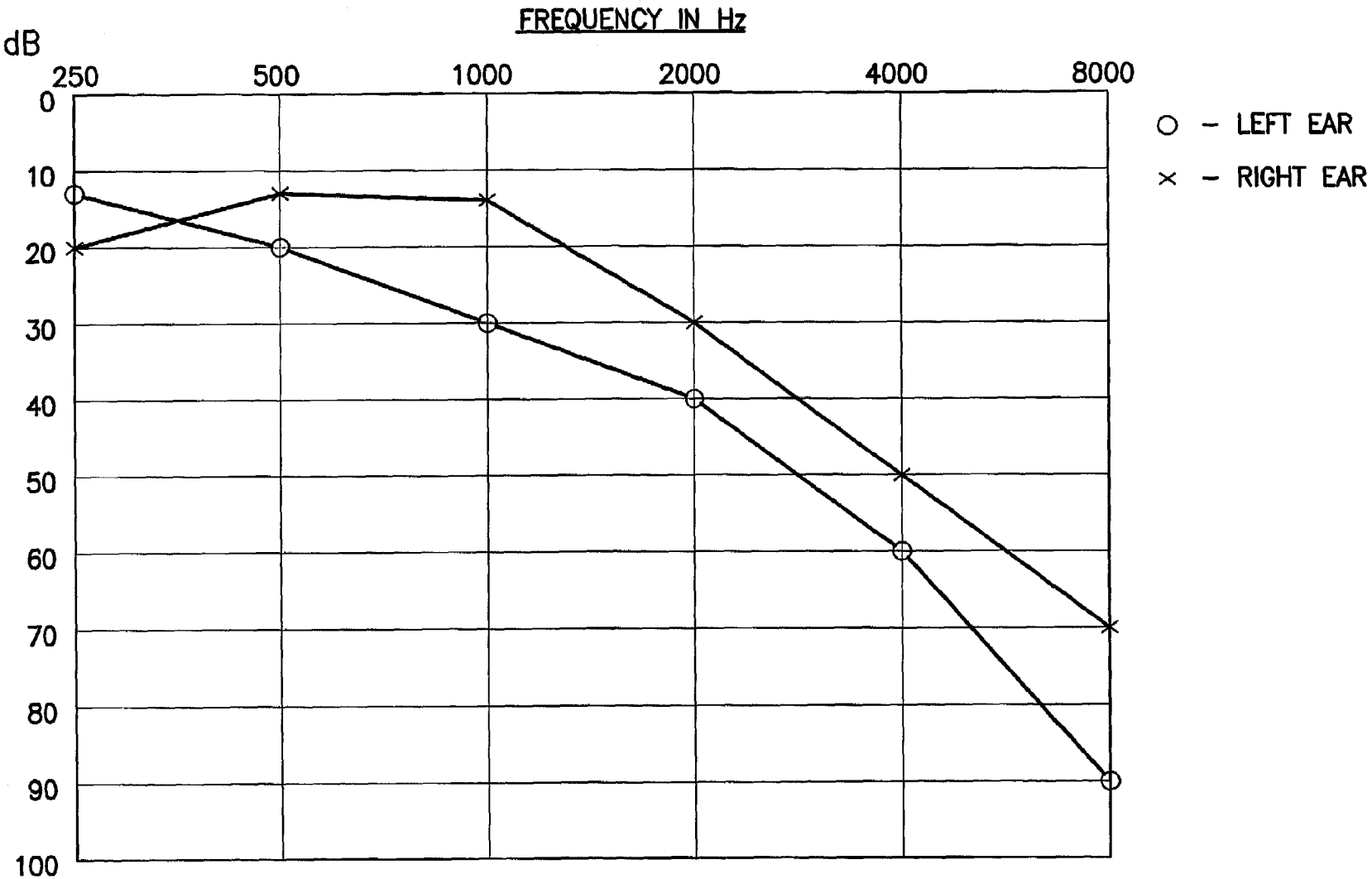
FIG. 4 is a chart of an example of a hearing profile for a person.

Referring to FIG. 4, a chart of an example of a hearing profile for a person is shown. In this example, the person has a hearing degradation which is progressively worse between 1000 Hz and 8000 Hz; being very pronounced at 8000 Hz.

The modifier 34 is intended to modify the signal 40 to separate predetermined portions of the sound signal 40 into two or more portions based upon a user's hearing profile. For example, for the user profile shown in FIG. 4, the sound signal might be separated into a first portion corresponding to the frequency range between 250–2000 Hz and a second portion corresponding to the frequency range between 2000–8000 Hz. The first portion might be output at the second output 44 unaltered. The second portion could be output at the first output 42, perhaps with a frequency shift towards the lower frequency range, to the second sound generator 36 for amplification. The two sound signal portions can then be added at the summation engine 38. In an alternate embodiment, the modifier could have more than two outputs, and the modifier could create more than two sound signal portions.

Figure 5:
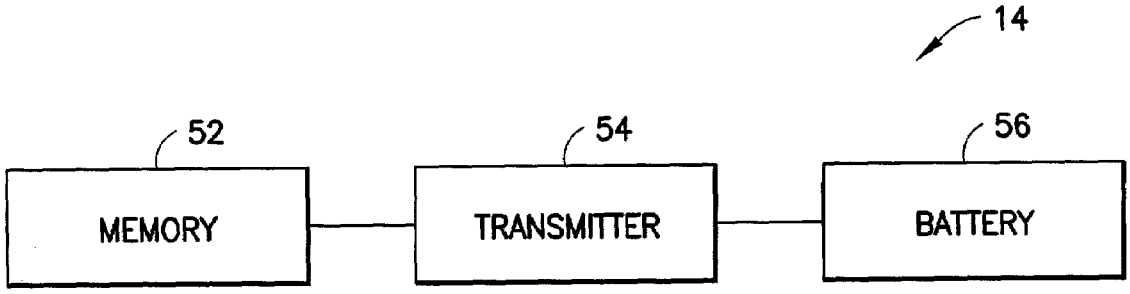
FIG. 5 is a block diagram of components of the user FOB shown in FIG. 1.

Referring also to FIG. 5, a block diagram of components of the user FOB 14 is shown. In an alternate embodiment, the user FOB 14 could comprise additional or alternative components. In this embodiment, the user FOB 14 generally comprises a memory 52, a transmitter 54, and a battery 56. The memory 52 is adapted to store information regarding the user's hearing profile therein. The transmitter 54 is preferably a low-power radio frequency transmitter. However, in alternate embodiments, any suitable type of transmitter could be provided. For example, the transmitter 54 might comprise an optical transmitter. In an alternate embodiment, the transmitter might comprise a transducer. The transmitter 54 is adapted to transmit 11 (see FIG. 1) information regarding the user's profile stored in the memory 52 of the user FOB 14 to the receiver 22 in the computer 16 of the sound device 12.

Because the transmitter 54 is preferably a low-power transmitter, the user FOB 14 must be moved into relatively close proximity with the receiver 22 before the receiver 22 will receive the transmitted signal from the transmitter. The user FOB 14 could comprise a user actuated switch to actuate the transmitter 54. In an alternate embodiment, the transmitter 54 could be adapted to periodically transmit information from the memory 52 or could be adapted to transmit the information based upon a predetermined event, such as the transmitter 54 comprising a transceiver which receives a signal to initiate the transmit procedure.

The present invention is intended to be a proactive system. The system can provide a programmed FOB carried on the person using the computer system that is equipped with features of the present invention. The FOB can hold the information for the specific user. The data can be programmed into the FOB via the Internet, or using a computer system or wireless connection. The FOB preferably holds the user's auditory characteristics in the nonvolatile memory to prevent the loss of data in the event of a battery failure. The auditory characteristics describe the user's audio hearing profile. The information can include the profile of a user's standard hearing test performed with an audiometer. An example of the information is shown in FIG. 4.

The FOB preferably contains a low-power transmitter device that periodically broadcasts binary data representing the user's hearing profile. Because the most power is consumed during transmit, the transmitter is preferably programmed to transmit at specific time intervals. The periodic transmit allows the FOB device to operate for an extended period of time before the battery needs replacement.

When the user approaches a computer system that is enabled with the present invention, the computer system detects the transmission of the user's data from the FOB and the user's hearing profile information is sent to the computer system. The computer system reprograms the audio generation hardware and software to modify the audio output for the particular user.

For example, if the user's hearing profile shows a sharp drop-off in hearing in the 7000 to 8000 KHz range, the computer system can use a software bandpass filter to capture the corresponding range of frequencies, and amplifies them. The result can then be added back into the audio data before it is generated. The present invention can capture and cache the audio data, before the sounds are generated by the sound card, by hooking the entry point after the sound generator, but before the first amplifier stage. The audio signal can be routed through a bandpass filter array to filter the target frequencies which need amplitude and/or frequency modification. The filters are programmable such that they can be changed by an instruction sequence from the computer system. The signal passed through the bandpass filter can be amplified, attenuated, or its frequency modified by a simple amplifier and frequency shifting component. The resultant signal is then added or concatenated to the signal that was blocked by the bandpass filter, and the resulting signal is used to drive the sound output generator portion of the computer system's sound card.

The present invention can be comprised in a computer having a central processing unit which resides in the user's computer system. The central processing unit can process internal data for delivery to the sound generator portion of the computer system by sending the sound generator a sequence or sequences of commands and data which are then used to generate the desired sound output to the speaker system. For example, if the computer system was receiving audio information from the Internet, the central processing unit would send the appropriate commands and data to the sound generator chip to allow the user to hear the audio representation of the data.

The sound generator prepares the data for output to the speakers attached to the user's computer system. The output of the sound generator is normally sent to a series of preamplifier and amplifier stages to prepare the signal for output to the speaker system. Instead of routing the signal to the preamplifier, the present invention can route the signal instead through a programmable bandpass filter/frequency shifter. The bandpass frequency is configured from the user's hearing profile obtained from the user's FOB via a low-power wireless connection. Using this information, the central processing unit can configure the characteristics of the bandpass filter.

For example, a user's hearing profile might show that the user has trouble hearing sounds in the 7000 to 8000 cycles (7–8 KHz) range, which can be separated out while the rest of the signal is sent to the summation component. If the amplitude needs to be adjusted, the signal passed through the bandpass filter can be routed through another sound generator stage where the signal is amplified. The resultant signal is then reassembled with the blocked portion at the summation engine. There, the two sound signals are merged and output to the user's speaker, sound card or audio system. The same method can be used to adjust the frequency of the signal.

In an alternate embodiment, the computer 16 could have more or less than the two sound generators 32, 36. The computer could also have a switch to bypass the modifier 34 if no signal is received by the receiver 22, or the filters in the modifier 34 could default to an off position if no signal is received by the receiver 22. The modifier 34 could comprise merely bandpass filters without a frequency shifter, or the frequency shifter could be separate.

Figure 6:
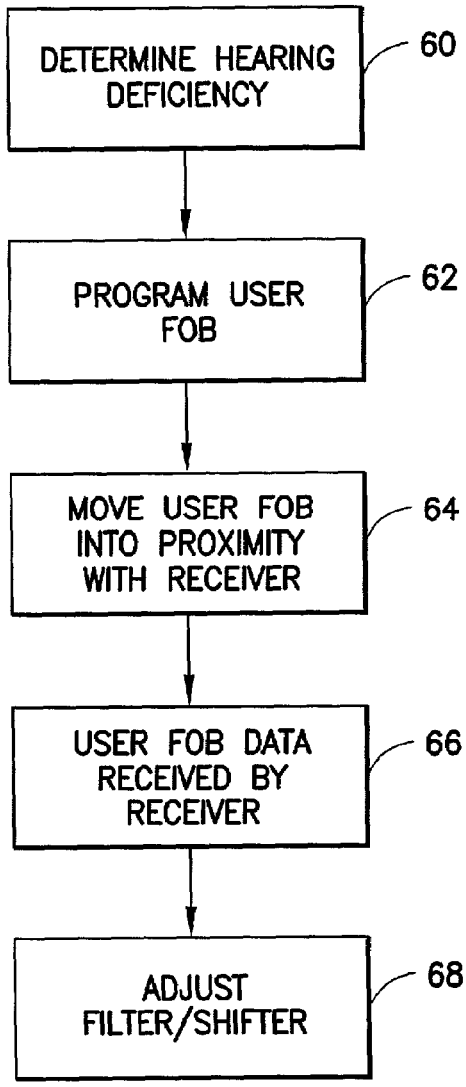

Referring specifically to FIG. 6, a method of the present invention can comprise determining 60 a user's hearing deficiency and programming 62 a user's FOB 14 with information regarding the hearing deficiency. When the user's FOB is moved 64 into proximity with the receiver, the data in the user FOB can be received 66 by the receiver. The central processing unit 30 can send commands to the modifier 44 to adjust 68 the filter/shifter 34. Thus, the computer 16 can automatically adjust the frequency and amplitude of sound emanating from the speakers 18 based upon a user's profile in the user FOB 14 carried by the user. The user does not need to manually adjust sound settings of the sound device 12. The adjustment is automatic. The adjustment is also configured to match the specific user's needs. The adjustment also automatically reconfigures for different users.

Figure 7:
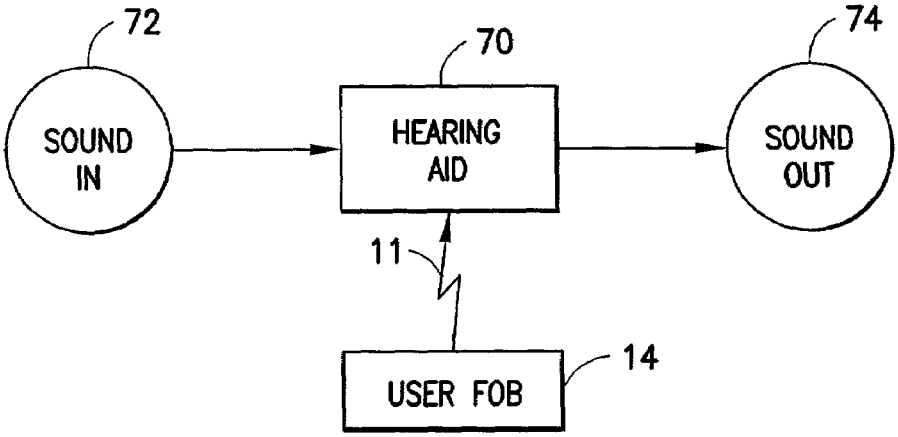
FIG. 7 is a block diagram of an alternate embodiment of the present invention.

Referring also to FIG. 7, an alternate embodiment of the present invention could be incorporated into a hearing aid 70. The hearing aid 70 could comprise a stereo headset or other similar device. The user's FOB 14 could transmit information 11 regarding the user's hearing profile to the hearing aid 70. The hearing aid 70 could modify sound 72 coming in, based upon the information received from the user FOB, into a modified outgoing sound 74 which adjusts the incoming sound to be more understandable or audible by the specific user. The hearing aid 70 could comprise one or more acoustic transducers, such as two acoustic transducers; one for each ear.

The user FOB 14 can be programmed with at least two separate user hearing profiles; such as one separate user hearing profile for each ear. Information regarding the two hearing profiles can be transmitted to the sound device such that the modifier 34 can modify the sound signal 40 based upon stereo sound output or similar multi-channel (non-monophonic) sound generation. Whether the sound device is the computer 16 with speakers 18, computer 16 with a stereo headset attached to the connector 26, the hearing aid 70, or some other type of sound device, the output sound can be configured for left and right side hearing variations of the individual user. Thus, if the user has a left ear that suffers from a hearing loss at 7–8 KHz, but the right ear does not suffer from this hearing loss, only the left channel of the sound signal might be modified; the right channel of the sound signal could be left un-modified. A person skilled in the art, after reading this description, should be able to configure the system of the present invention for use with any suitable type of sound system. Features of the present invention could be used by individual in home computers, home audio sound systems, home television/entertainment systems, automobile sound systems, headset sound players such as found in public libraries and museums, and professional sound mixing studios, for example.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A system for adjusting audio output comprising:

a transmitter unit adapted to be carried by a user, the transmitter unit comprising a memory and a signal transmitter; and an entertainment sound generating system comprising a sound generator adapted to output entertainment sound signals based upon input entertainment data, a signal receiver, means for automatically altering the entertainment sound signals from the sound generator based upon a signal automatically transmitted by the signal transmitter to the receiver, and at least one acoustic transducer coupled to the altering means, wherein the sound generator comprises a player adapted to play the entertainment data.

2. A system for adjusting audio output as in claim 1 wherein the transmitter unit further comprises a battery connected to the signal transmitter.

3. A system for adjusting audio output as in claim 2 wherein the memory comprises a nonvolatile memory.

4. A system for adjusting audio output as in claim 1 wherein the transmitter unit is adapted for reprogramming of the memory.

5. A system for adjusting audio output as in claim 1 wherein the altering means comprises a processor connected to the signal receiver and the sound generator.

6. A system for adjusting audio output as in claim 5 wherein the altering means comprises an electrical sound signal modifier connected to an output of the sound generator and controlled by the processor.

7. A system for adjusting audio output as in claim 6 wherein the altering means comprises a second sound generator connected to a first output from the electrical sound signal modifier.

8. A system for adjusting audio output as in claim 7 wherein the altering means further comprises a combiner connected to a second output from the electrical sound signal modifier and connected to an output from the second Sound generator.

9. A system for adjusting audio output as in claim 6 wherein the electrical sound signal modifier is adapted to filter target freguencies, based upon information in the signal transmitted by the signal transmitter, which need amplitude and/or frequency modification.

10. A system for adjusting audio output as in claim 6 wherein the electrical sound signal modifier comprises a bandpass filter array.

11. A system for adjusting audio output as in claim 10 wherein the electrical sound signal modifier comprises a frequency shifter.

12. A system for adjusting audio output as in claim 1 wherein the at least one acoustic transducer comprises speakers.

13. A system for adjusting audio output as in claim 1 wherein the transmitter unit comprises:

a battery;

the signal transmitter connected to the battery for transmitting a wireless signal; and the memory connected to the signal transmitter, the memory comprising hearing information regarding a user's auditory characteristics, wherein the signal transmitter is adapted to transmit at least a portion of the hearing information stored in the memory.

14. A system for adjusting audio output as in claim 13 wherein the memory comprises a nonvolatile memory.

15. A system for adjusting audio output as in claim 13 wherein the transmitter unit is adapted to broadcast the hearing information at periodic time intervals.

16. A system for adjusting audio output as in claim 13 wherein the transmitter unit is adapted for reprogramming of the memory.

17. A system for adjusting audio output as in claim 1 wherein the sound generating system comprises:

a processor;

the sound generator being provided as a first sound generator coupled to the processor;

a second sound generator coupled to the first sound generator by a programmable sound signal modifier;

a combiner for combining an output from the second sound generator with a portion of an output from the signal modifier; and wherein the signal receiver comprises a wireless signal receiver coupled to the processor, the receiver being adapted to receive a hearing information signal containing a user's auditory characteristics, wherein the processor is adapted to configure the modifier based upon the hearing information signal received by the receiver.

18. A system for adjusting audio output as in claim 17 wherein the signal modifier is adapted to filter target frequencies, based upon information in the hearing information signal, which need amplitude and/or frequency modification.

19. A system for adjusting audio output as in claim 17 wherein the sound signal modifier comprises a bandpass filter array.

20. A system for adjusting audio output as in claim 19 wherein the sound signal modifier comprises a frequency shifter.

21. A system for adjusting audio output comprising:

a transmitter unit adapted to be carried by a user, the transmitter unit comprising a memory and a signal transmitters; and an entertainment sound generating system comprising a sound generator adapted to output entertainment sound signals based upon input entertainment data, a signal receiver, means for altering the entertainment sound signals from the sound generator based upon a signal transmitted by the signal transmitter to the receiver, and at least one acoustic transducer coupled to the altering means, wherein the sound generator comprises a player adapted to play the entertainment data, wherein the memory comprises hearing information regarding a user's auditory characteristics.

22. A system for adjusting audio output as in claim 21 wherein the transmitter unit is adapted to broadcast the hearing information at periodic time intervals.

23. A method of altering an electrical sound signal in an entertainment sound system comprising steps of:

receiving a hearing adjustment signal by the entertainment sound system from a portable transmitter, the hearing adjustment signal comprising information regarding a user's auditory characteristics;

configuring a variable signal modifier based upon the received hearing adjustment signal; and transmitting the electrical sound signal through the variable signal modifier and outputting at least one altered electrical sound signal which has been altered based upon the user's auditory characteristics contained in the hearing adjustment signal to generate entertainment sound from a speaker or sound transducer of the entertainment Sound system which is spaced from ears of the user.

24. A method as in claim 23 wherein the variable signal modifier comprises a bandpass filter array which filters target frequencies which need amplitude and/or frequency modification.

25. A method as in claim 24 wherein the variable signal modifier comprises a first output and a second output, the first output comprising frequencies filtered by the bandpass filter array and the second output comprising frequencies not filtered by the bandpass filter array.

26. A method as in claim 25 wherein the first output is amplified by a sound generator and then combined with the second output.

27. A method as in claim 24 wherein the variable signal modifier comprises a frequency shifter which shifts a frequency of at least one of the target frequencies.

28. A method as in claim 23 wherein the step of receiving a hearing adjustment signal comprises at least two signals comprising a first signal corresponding to a right ear of the user's auditory characteristics and a second signal corresponding to a left ear of the user's auditory characteristics.

29. A method as in claim 23 wherein the step of receiving a hearing adjustment signal comprises receiving separate information regarding the user's auditory characteristics for a left ear and for a right ear.

30. A system for adjusting audio output comprising:

a transmitter unit adapted to be carried by a user, the transmitter unit comprising a memory and a signal transmitter; and a sound generating system comprising a sound generator adapted to output sound signals based upon input data, a signal receiver, an altering system for altering the sound signals from the sound generator based upon a signal transmitted by the transmitter to the receiver, and at least one acoustic transducer/speaker coupled to the altering system, wherein the sound generating system is not adapted to be entirely carried by the user, and wherein the transmitter unit is adapted to automatically send the signal to the receiver without user activation.

31. A system for adjusting audio output as in claim 30 wherein the transmitter unit is adapted to periodically transmit the signal.

32. A system for adjusting audio output as in claim 30 wherein the transmitter unit is adapted to automatically transmit the signal based upon a predetermined event.

* * * * *